US005265285A

United States Patent [19]

Loebbert

[11] Patent Number: 5,265,285

[45] **Date of Patent: * Nov. 30, 1993**

[54] TOILET WITH A DISPOSABLE BAG

[76] Inventor: Johannes Loebbert, Industriestrasse 1, 4405, Nottuln 2, Fed. Rep. of Germany

[ * ] Notice: The portion of the term of this patent subsequent to Dec. 24, 2008 has been disclaimed.

[21] Appl. No.: 840,354

[22] Filed: Feb. 24, 1992

[30] Foreign Application Priority Data

Feb. 23, 1991 [DE] Fed. Rep. of Germany ... 9102169[U]

[51] Int. Cl.[5] ..... A47K 11/06

[52] U.S. Cl. ..... 4/484

[58] Field of Search ..... 4/460, 479, 485, 484, 4/242.1; 383/33

[56] References Cited

U.S. PATENT DOCUMENTS

| | | | |
|---|---|---|---|
| 132,775 | 11/1872 | Prangley | 4/242.1 X |
| 857,914 | 6/1907 | Weber | 4/479 X |
| 2,974,321 | 3/1961 | Salka | 4/484 X |
| 3,047,883 | 8/1962 | Van Syoc | 4/484 |
| 3,078,470 | 2/1963 | Rosenfeld | 4/484 |
| 3,444,563 | 5/1969 | Gordon | 4/484 |
| 4,633,536 | 1/1987 | Tribble-Du Bose | 4/460 |

FOREIGN PATENT DOCUMENTS

| | | | |
|---|---|---|---|
| 2173097 | 10/1986 | United Kingdom | 4/460 |

*Primary Examiner*—Charles E. Phillips
*Attorney, Agent, or Firm*—Sprung Horn Kramer & Woods

[57] ABSTRACT

A portable toilet has (1) a seat with an opening; (2) an annular bag arranged beneath the opening for collecting waste, the upper edge of the bag being secured to the seat; and (3) an overall framework for supporting the seat which may be folded together to save space when the toilet is not being used. A supporting edge is provided around the inside of the opening through the seat for holding the annular bag and the bag is suspended from the holder by a relatively rigid collar around the top of the bag. The framework comprises at least two facing components articulated to the seat.

16 Claims, 3 Drawing Sheets

TOILET WITH A DISPOSABLE BAG

BACKGROUND OF THE INVENTION

The present invention concerns a portable toilet with a disposable bag. The toilet has a seat with an annular bag holder. The upper edge of the bag fits at least to some extent over the holder, which secures it while the user sits on the toilet. Also attached to the annular holder is an overall framework, which folds up against the ring to save space when the toilet is not being used.

A toilet with a disposable bag is known from the U.S. Pat. No. 2,801,426. Its seat is hinged to an annular bag holder. The holder is fastened either to a wall or to a fit-together framework when the toilet is set up. The bag is positioned in the holder's opening and the seat folded down over it. Drawstrings along the edges of the seat draw the top of the bag tight and facilitate its removal when the seat is lifted after use.

One drawback to this toilet is that the joints in the framework eventually become looser and it can no longer secure the holder reliably enough, so that the stability of the toilet as a whole deteriorates. Furthermore, simply drawing the top of the bag tight and removing it does not eliminate odor and contamination.

SUMMARY OF THE INVENTION

The principal object of the present invention is accordingly to improve a portable toilet of the aforesaid type by eliminating its drawbacks and rendering it easier and more pleasant and hygienic to use.

This object, as well as other objects that will become apparent from the discussion that follows, are attained in accordance with the invention in a portable toilet with a disposable bag by providing a supporting edge around the inside of the hole through the seat as the annular bag holder, by providing the bag with a relatively rigid collar around its open top which can be suspended from the bag holder, and by providing the toilet framework with at least two facing components articulated to the seat.

The bag holder is accordingly now part of the toilet seat, making it more hygienic to use. Another particular advantage is that the framework components articulated to the seat ensure a more stable toilet once it has been set up.

The bag is preferably formed in two parts: a reservoir or bag portion surrounded by the rigid collar at the open top, which merges into an inverted ridge, and a cover, which has an inverted groove around it designed to mate with the rigid collar.

The supporting edge, which is in the form of an elevation along the inside circumference of a groove, is high enough to ensure that the inverted groove around the bag's cover will be forced tight over the inverted ridge on it's collar, generating a secure seal, by a toilet lid when it is lowered to close the toilet. The cover is preferably provided with a handle.

These measures make the toilet even more hygienic and pleasant to use. The sealed cover on the bag extensively eliminates odor, and the secure attachment between the reservoir and the cover facilitates removing the bag.

In the preferred embodiment of the invention, the components of the framework are in the form of walls.

There is preferably a lateral wall on each side of the seat and a rear wall between them. The framework components, especially the lateral and rear walls, can be attached to the seat by hinges.

The lateral and rear walls are preferably perforated to provide space to accommodate the bag when the toilet is folded together.

It is preferable for the lateral and rear walls to have snap fasteners to stabilize them and hence the toilet as a whole. The movable components of the toilet can be unexceptionably secured together, when the toilet is folded together, by halves of a latch, especially a magnetic latch, on the lateral walls.

Recesses on the lateral walls facilitate setting the toilet up and a recess on the seat facilitates lifting the lid.

A structure in the form of a grip, preferably at the rear of the lower surface of the lid and separate from the seat, facilitates carrying the toilet and making it even more convenient to use. Since the lid remains down and the rear wall hangs down while the toilet is carried around, the magnetic latch must only keep the lateral walls together. The folded-together toilet is especially easy to carry around due to the position of its center of gravity and to its facing away from the person carrying it.

Advantageously, the toilet's seat, lid, and lateral and rear walls are made of wood and/or plastic.

The preferred embodiment of the present invention will now be described with reference to the accompanying drawings.

DESCRIPTION OF THE PREFERRED EMBODIMENT

Figure 1:
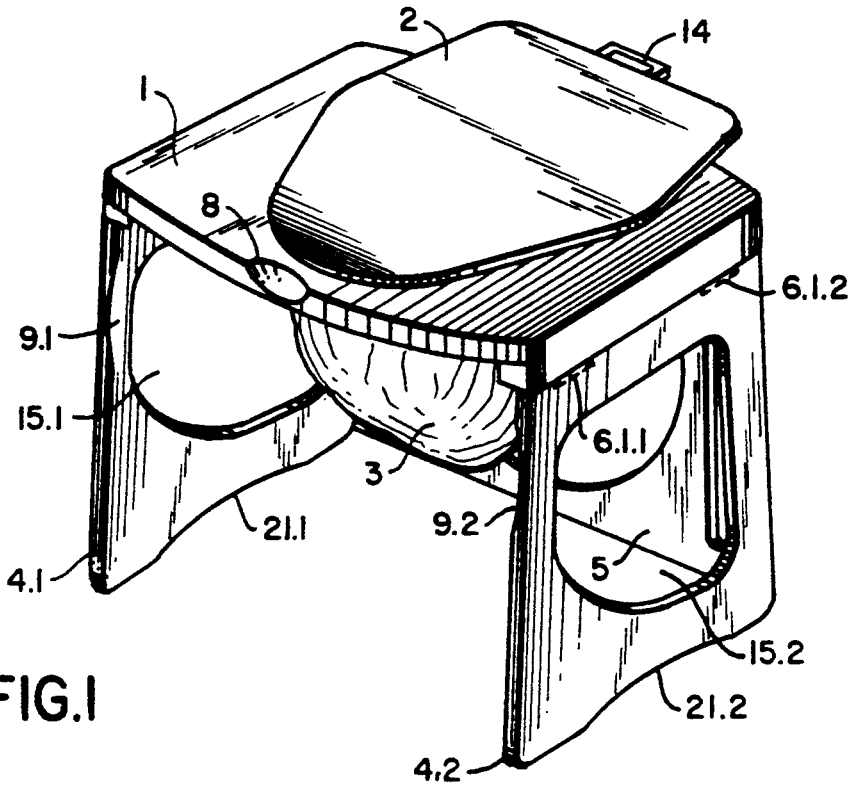
FIG. 1 is a perspective, front view of the preferred embodiment of the portable toilet according to the invention, with the toilet seat down.
Figure 2:
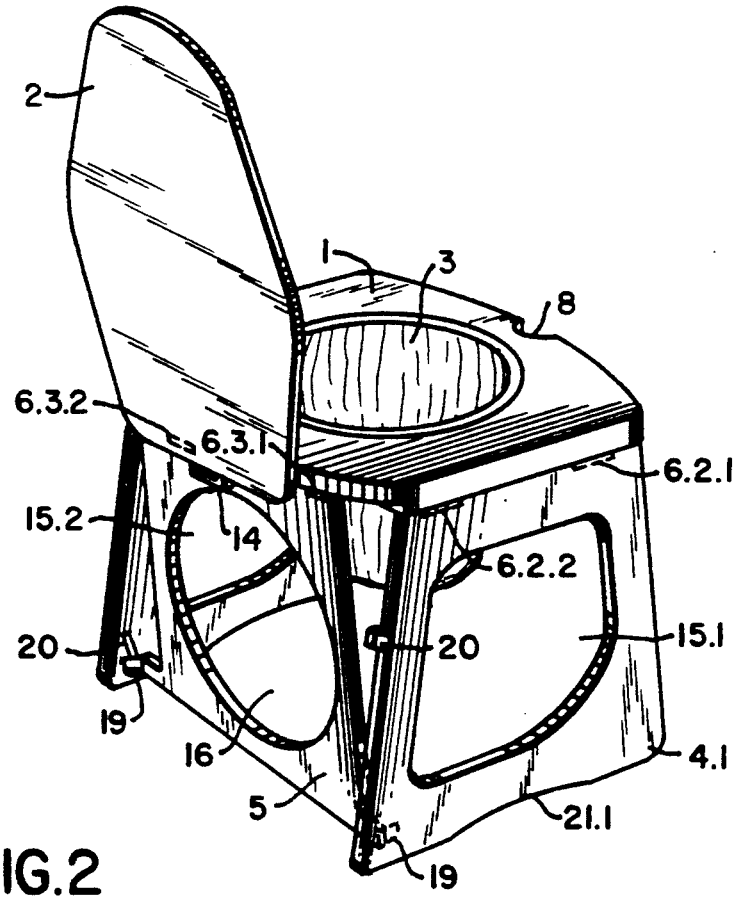
FIG. 2 is a perspective, rear view of the same toilet with the toilet seat up.
Figure 3:
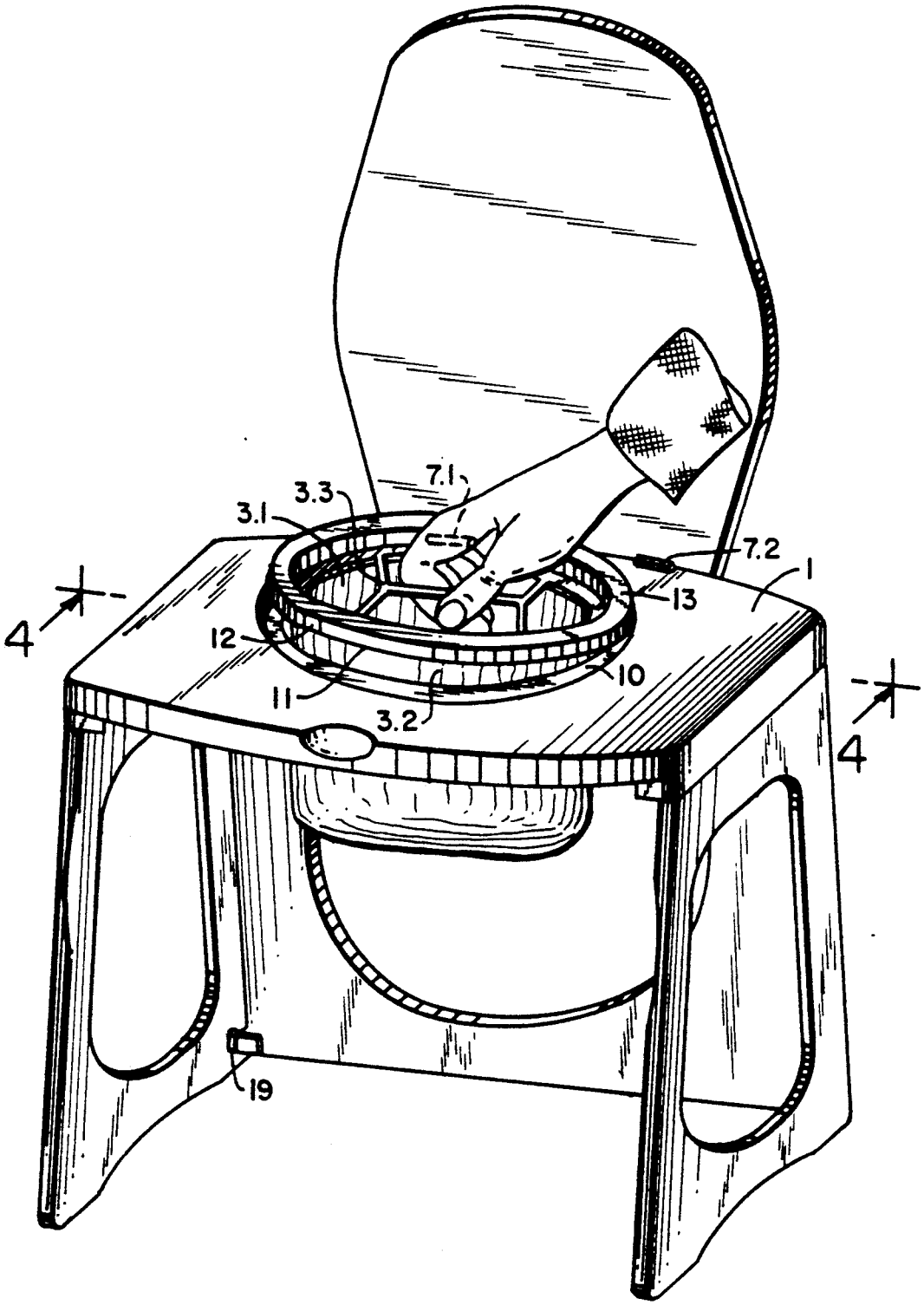
FIG. 3 is a perspective view of the same toilet showing components of the holder with the toilet seat up and the bag partially lifted out.

As illustrated in FIGS. 1–3, the essential elements of the portable toilet are a seat 1 with a bag 3 suspended from it for intercepting and collecting waste, a lid 2 attached to the seat, lateral walls 4.1 and 4.2 with perforations 15.1 and 15.2, and a rear wall 5 with a perforation 16. The lateral walls 4.1 and 4.2 are secured to the seat 1 by hinges 6.1.1, 6.1.2, 6.2.1, and 6.2.2, the rear wall 5 by hinges 6.3.1 and 6.3.2, and the lid 2 by hinges 7.1 and 7.2. On the bottom rear inner surfaces of the lateral walls 4.1 and 4.2 and opposite them on the rear wall 5 are snap fasteners 19. Also on the lateral walls 4.1 and 4.2 are the two halves, respectively, of a magnetic latch 20. In the seat 1 and on the lateral walls 4.1 and 4.2 are recesses 8, 9.1, and 9.2 to facilitate gripping. The bottoms of the lateral walls 4.1 and 4.2 have curved areas 21.1 and 21.2 scooped out of them to create leg-like structures at each end.

Figure 4:
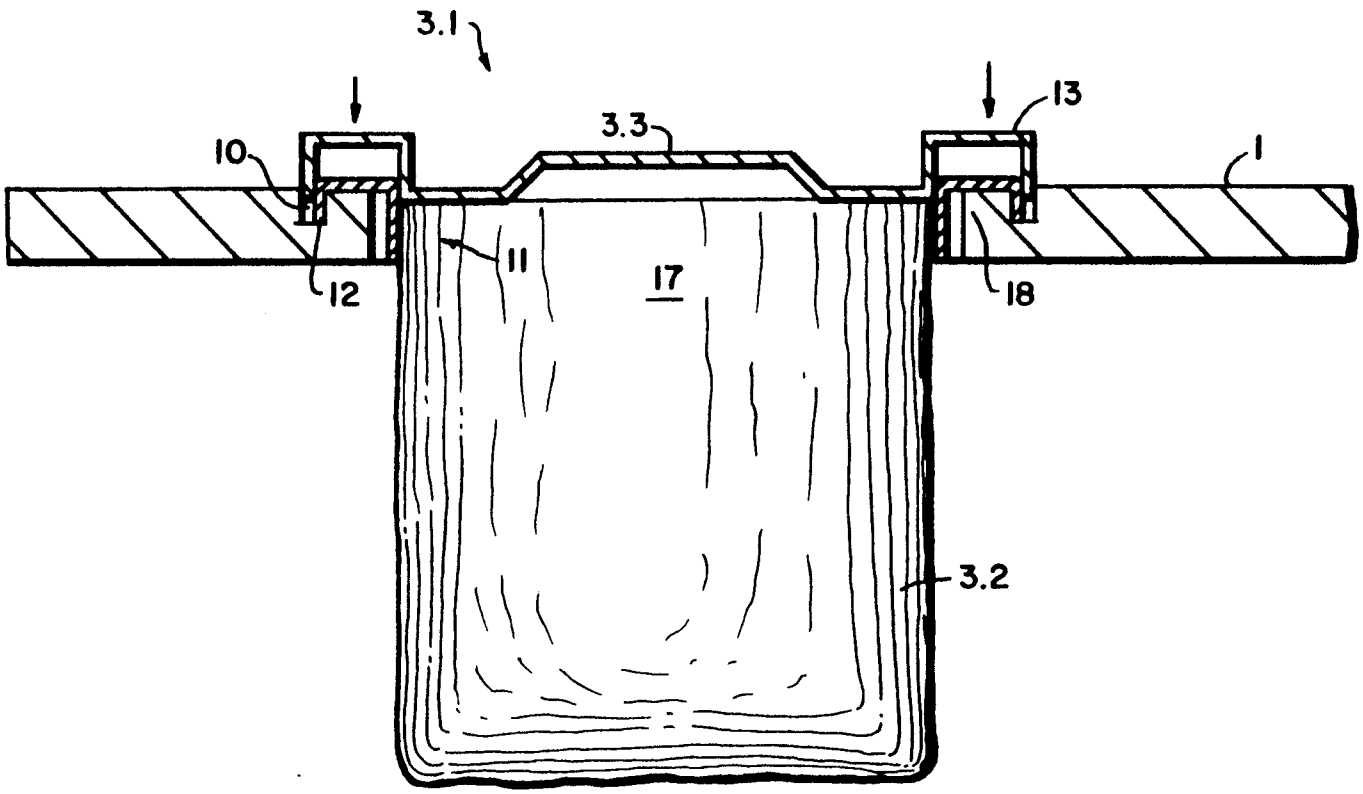
FIG. 4 is a cross-sectional view through the seat and bag of the same toilet.

FIGS. 3 and 4 illustrate a bag 3 with a cover 3.1, a handle 3.3, and a reservoir portion 3.2. The reservoir 3.2 is surrounded by a relatively rigid collar 11 that merges into an inverted ridge 12. The ridge 12 fits tightly in an inverted groove 13 around the edge of cover 3.1. The edge 18 that supports the bag 3 is the inner elevation of a groove 10 around the inside of the opening 17 through the seat 1.

With the toilet folded together, the rear wall 5 rests against the bottom of the seat 1, followed by the left lateral wall 4.1 and the right lateral wall 4.2, held together by the magnetic latch 20. Perforations 15.1, 15.2, and 16 leave room for the bag 3. At the bottom rear of the lid 2 is a structure 14 in the form of a grip for carrying the toilet around.

To use the toilet, the lateral walls 4.1 and 4.2 are folded down by gripping them at recesses 9.1 and 9.2 and the rear wall 5 is snapped into position, creating a stable framework. The lid 2 is lifted by gripping it through the recess 8 and the bag 3 is opened by removing its cover 3.1. Once the toilet has been used, the cover 3.1 is replaced over the reservoir portion 3.2. The lid 2 is lowered and forced down to press the groove 13 over the ridge 12 to the full extent of the prescribed height of the groove. The accordingly sealed bag 3 can be lifted out by means of a handle 3.3 on the cover 3.1 and disposed of.

There has thus been shown and described a novel portable toilet with a disposable bag which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. In a portable toilet with a disposable bag, said toilet including (1) a seat with an opening; (2) an annular bag arranged beneath the opening for collecting waste, the upper edge of the bag being secured to the seat; and (3) an overall framework for supporting the seat which may be folded together to save space when the toilet is not being used; the improvement wherein the bag is formed of a relatively flexible reservoir portion surrounded by a relatively rigid collar at the upper edge which merges into an inverted ridge, and a bag cover, which has an inverted groove around its periphery that fits onto the inverted ridge in a mating fashion; wherein a supporting edge is provided around the opening through the seat for holding the annular bag, and wherein the bag is suspended from the supporting edge by the rigid collar.

2. The toilet defined in claim 1, wherein the framework comprises at least two facing components articulated to the seat.

3. The toilet defined in claim 1, further comprising a toilet lid; and wherein the supporting edge, which is in the form on an elevation along the inside circumference of a groove, is high enough to ensure that the inverted groove around the bag cover will be forced tight over the inverted ridge on the rigid collar, generating a secure seal, by the toilet lid when it is lowered to close the toilet.

4. The toilet defined in claim 3, wherein a grip is provided at the rear of the lower surface of the toilet lid, and separate from the seat, to facilitate carrying the toilet when folded.

5. The toilet defined in claim 3, wherein a recess is provided on the seat to facilitate lifting the toilet lid.

6. The toilet defined in claim 1, wherein the components of the framework are in the form of walls.

7. The toilet defined in claim 6, wherein a lateral wall is provided on each side of the seat and a rear wall is provided between them.

8. The toilet defined in claim 7, wherein the lateral and rear walls are perforated to provide space to accommodate the bag when the toilet is folded together.

9. The toilet defined in claim 7, wherein the lateral and rear walls are attached to the seat by hinges.

10. The toilet defined in claim 7, wherein the lateral and rear walls have snap fasteners arranged to hold them in the upright position.

11. The toilet defined in claim 7, wherein the seat, and lateral and rear walls are made of wood.

12. The toilet defined in claim 7, further comprising two halves of a latch, each arranged on a respective one of the lateral walls for holding the lateral walls together when folded.

13. The toilet defined in claim 12, wherein the latch is a magnetic latch.

14. The toilet defined in claim 7, wherein the seat, and lateral and rear walls are made of plastic.

15. The toilet defined in claim 7, wherein recesses are provided on the lateral walls to facilitate setting the toilet up.

16. The toilet defined in claim 1, wherein the bag cover has a handle for carrying the bag when the cover is in place.

* * * * *